US008791964B2

(12) United States Patent
Park et al.

(10) Patent No.: US 8,791,964 B2
(45) Date of Patent: Jul. 29, 2014

(54) DISPLAY APPARATUS AND METHOD OF CONTROLLING THE SAME

(75) Inventors: Jae-sung Park, Seoul (KR); Tae-hyeun Ha, Suwon-si (KR); Hyung-rae Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 714 days.

(21) Appl. No.: 12/855,768

(22) Filed: Aug. 13, 2010

(65) Prior Publication Data

US 2011/0234643 A1 Sep. 29, 2011

(30) Foreign Application Priority Data

Mar. 24, 2010 (KR) ..... 10-2010-0026162

(51) Int. Cl.
*G09G 5/10* (2006.01)

(52) U.S. Cl.
USPC ..... 345/690; 345/77

(58) Field of Classification Search
USPC ..... 345/211, 77, 690
See application file for complete search history.

(56) References Cited

U.S. PATENT DOCUMENTS

| | | | | |
|---|---|---|---|---|
| 5,444,492 | A * | 8/1995 | Kihara | 348/445 |
| 5,719,958 | A * | 2/1998 | Wober et al. | 382/199 |
| 6,781,605 | B2 * | 8/2004 | Kudo et al. | 345/690 |
| 7,038,728 | B2 * | 5/2006 | Kim et al. | 348/445 |
| 7,956,927 | B2 | 6/2011 | Kiuchi et al. | |
| 8,456,405 | B2 * | 6/2013 | Oohira | 345/99 |
| 2002/0047822 | A1 * | 4/2002 | Senda et al. | 345/90 |
| 2003/0146897 | A1 * | 8/2003 | Hunter | 345/102 |
| 2003/0169217 | A1 * | 9/2003 | Kang et al. | 345/63 |
| 2003/0222840 | A1 * | 12/2003 | Koga et al. | 345/89 |
| 2005/0052446 | A1 * | 3/2005 | Plut | 345/211 |
| 2005/0270265 | A1 * | 12/2005 | Plut | 345/102 |
| 2007/0146344 | A1 | 6/2007 | Martin et al. | |
| 2007/0177067 | A1 * | 8/2007 | Kim et al. | 349/43 |
| 2010/0253696 | A1 * | 10/2010 | Choi | 345/589 |

FOREIGN PATENT DOCUMENTS

| | | | |
|---|---|---|---|
| JP | 2003-345297 | A | 12/2003 |
| JP | 2007-104377 | A | 4/2007 |
| JP | 2007-219234 | A | 8/2007 |
| JP | 2007-298693 | A | 11/2007 |
| JP | 2009-520993 | A | 5/2009 |
| JP | 2009-237510 | A | 10/2009 |
| JP | 2010-078982 | A | 4/2010 |
| WO | 2006/049058 | A1 | 5/2006 |
| WO | 2007/071049 | A1 | 6/2007 |

OTHER PUBLICATIONS

Communication from the Japanese Patent Office dated May 20, 2014, in a counterpart Japanese application No. 2010-204228.

* cited by examiner

*Primary Examiner* — Dwayne Bost
*Assistant Examiner* — Robert Michaud
(74) *Attorney, Agent, or Firm* — Sughrue Mion, PLLC

(57) ABSTRACT

A display apparatus and method of controlling the same are disclosed, the display apparatus including: a display unit; an image processor configured to process an image and display the processed image on the display unit; and a controller configured to control the image processor to adjust a brightness of an inattentive area of the image displayed on the display unit depending on whether a user is able to recognize a corresponding brightness change, determined based on image information, such that the controller controls the image processor to adjust the brightness of the inattentive area if the controller determines, based on the image information, that the user is not able to recognize the corresponding brightness change.

25 Claims, 10 Drawing Sheets

DISPLAY APPARATUS AND METHOD OF CONTROLLING THE SAME

CROSS-REFERENCE TO RELATED APPLICATION

This application claims priority from Korean Patent Application No. 10-2010-0026162, filed on Mar. 24, 2010 in the Korean Intellectual Property Office, the disclosure of which is incorporated herein by reference in its entirety.

BACKGROUND

1. Field

Apparatuses and methods consistent with the exemplary embodiments of the general inventive concept relate to a display apparatus and a method of controlling the same, and more particularly, to a display apparatus and a method of controlling the same capable of improving an image quality sensed by a user by controlling the brightness of an image in consideration of a psycho-visual characteristic of the user.

2. Description of the Related Art

A display apparatus may control the brightness of an image to accomplish various objects, for example, to improve an image quality, reduce a power consumption, and extend the lifespan of a self-emitting display element such as an organic light emitting diode (OLED) or plasma display panel (PDP). Generally, when the brightness of the image is controlled, the contrast of an image has been merely improved or the brightness of an area of the image where no image data exists has been merely adjusted without consideration of the psycho-visual characteristic of a user.

In this case, various methods for compensating a reduced brightness level have been suggested. However, such methods may cause various undesired results.

SUMMARY

Accordingly, one or more exemplary embodiments provide a display apparatus and a method of controlling the same, capable of improving an image quality sensed by a user and reducing power consumption by controlling the brightness of an input image based on an image analysis performed depending on the psycho-visual characteristic of a user after an area to which the user is attentive and the other areas are separately detected from the image.

The foregoing and/or other aspects may be achieved by providing a display apparatus including: a display unit; an image processor configured to process an image and display the processed image on the display unit; and a controller configured to control the image processor to adjust a brightness of an inattentive area of the image displayed on the display unit depending on whether or not a user is able to recognize a corresponding brightness change, determined based on image information. The controller controls the image processor to adjust the brightness of the inattentive area if the controller determines that, based on the image information, the user is not able to recognize the corresponding brightness change.

The controller may control the image processor to adjust the brightness of a portion of the inattentive area where the user is not able to recognize the brightness change based on the image information.

The controller may determine the inattentive area based on at least one of a factor related to a specific area in the image and another factor related to whether or not effective image data exists therein.

The controller unit may determine a central area of the image as an attentive area and other areas of the image, except for the attentive area, as the inattentive area.

The image information may include a frequency, a contrast, and an edge characteristic of the image.

The controller may determine an area of the inattentive area of the image having a frequency above a predetermined frequency level as an area where the user is not able to recognize the corresponding brightness change thereof.

The controller may determine an area of the inattentive area of the image having a contrast below a predetermined contrast level as an area where the user is not able to recognize the corresponding brightness change thereof.

The controller may determine a brightness adjustment level of the inattentive area in consideration of whether or not a local dimming is performed.

The controller may adjust the brightness of the inattentive area of the image by controlling a gray scale of the image.

The display unit may include a backlight, the controller adjust the brightness of the inattentive area of the image by controlling the backlight.

Another aspect of the general inventive concept may be achieved by providing a method for controlling a display apparatus, the method including: determining an attentive area of an image and an inattentive area of the image; adjusting a brightness of the inattentive area depending on whether or not a user is able to recognize a corresponding brightness change, determined based on image information; and displaying the inattentive area according to the adjusted brightness. The brightness of the inattentive area is adjusted if determined based on the image information that the user is not able to recognize the corresponding brightness change.

The brightness of a portion of the inattentive area where the user may be not able to recognize the brightness change is adjusted based on the image information.

The inattentive area may be determined based on at least one of a factor related to a specific area in the image and another factor related to whether or not effective image data exists.

The central area of the image may be determined as an attentive area and other areas of the image, except for the attentive area, is determined as the inattentive area.

The image information may include a frequency, a contrast, and an edge characteristic of the image.

The area of the inattentive area of the image having a frequency above a predetermined frequency level may be determined as an area where the user is not able to recognize the corresponding brightness change thereof.

The area of the inattentive area of the image having a contrast below a predetermined contrast level may be determined as an area where the user is not able to recognize the corresponding brightness change thereof.

A brightness adjustment level of the inattentive area may be determined in consideration of whether or not a local dimming is performed.

The brightness of the inattentive area of the image may be adjusted by controlling a gray scale of the image.

The display apparatus may include a backlight, a brightness of the inattentive area of the image is adjusted by controlling the backlight.

BRIEF DESCRIPTION OF THE DRAWINGS

The above and/or other aspects will become apparent and more readily appreciated from the following description of the exemplary embodiments, taken in conjunction with the accompanying drawings, in which.

DETAILED DESCRIPTION OF EXEMPLARY EMBODIMENTS

Figure 1:
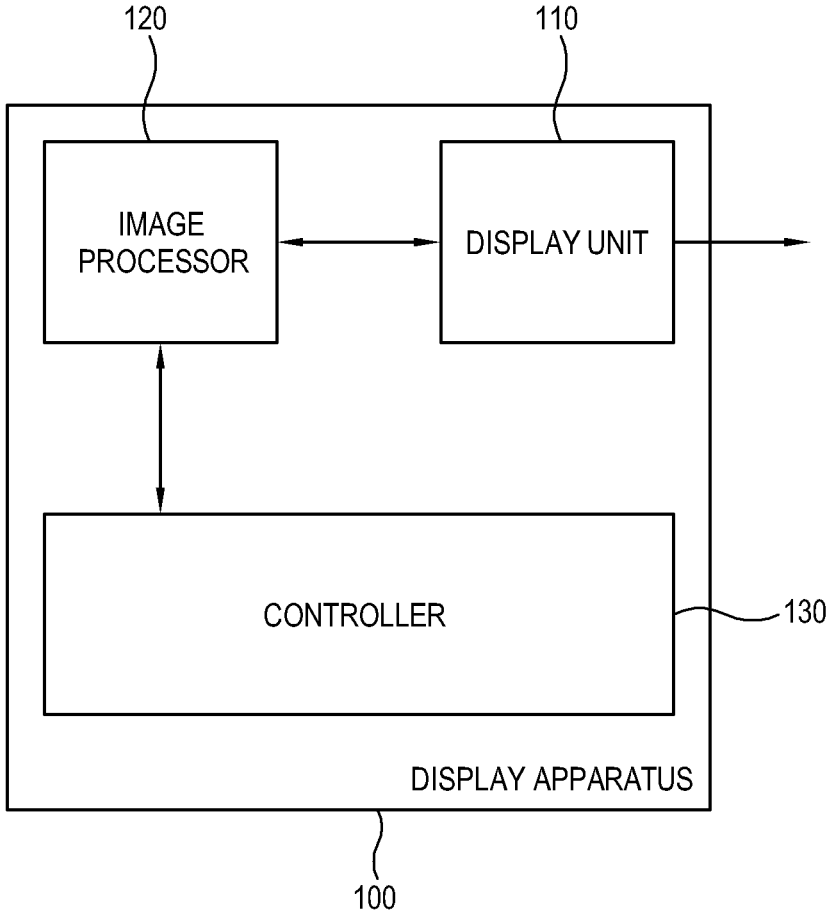
FIG. 1 shows a block diagram of a display apparatus in accordance with an exemplary embodiment.

Below, exemplary embodiments will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout.

FIG. 1 shows a structure of a display apparatus 100 in accordance with an exemplary embodiment.

The display apparatus 100 of the present exemplary embodiment may be a television (TV), a large format display (LFD), a monitor, a desk top computer, a lap top computer, a set top box, and/or the like. Further, the display apparatus 100 of the present exemplary embodiment may be any electronic device for displaying an image and which is capable of controlling the brightness per area of the image.

The display apparatus 100 of the present exemplary embodiment may include a display unit 110, an image processor 120, and a controller 130.

The display unit 110 may display an image processed by the image processor 120. Herein, the display unit 110 may include a display panel (not shown) embodied as a liquid crystal display (LCD), an organic light emission diode (OLED), a plasma display panel (PDP), or the like and a panel driver (not shown) for driving the display panel.

When the display panel is embodied as a passive display device such as an LCD, the display unit 110 may include a backlight (not shown) for emitting a light at a back side of the display panel. On the other hand, when the display panel is embodied as an active display device such as an OLED or a PDP, the display unit 110 may not need to include a backlight.

The image processor 120 may process image data to display a corresponding image on the display unit 110. Specifically, the image processor 120 may perform at least one of decoding, scaling, brightness control, contrast control, luminosity control, and image enhancement.

The controller 130 may control the image processor 120 to adjust the brightness of a user's inattentive area of an image displayed on the display unit 110 according to whether or not a user can recognize an adjustment of the image, determined based on image information.

An area to which a user is mostly attentive to is referred to as an attentive area, and an area to which the user is least attentive to (i.e., mostly inattentive to) is referred to as an inattentive area. The inattentive area may include the other areas of the image except for the attentive area of the image. In this case, the controller 130 may divide an image into the attentive area and the inattentive area based on various standards. Specifically, the controller 130 may determine the inattentive area based on at least one of a factor related to a specific area in the image and another factor related to whether or not effective (or ineffective) image data exists.

In the case of determining the inattentive area based on the factor related to a specific area in an image, a central area of the image may be determined as the attentive area of a user, and the other areas except for the attentive area may be determined as the inattentive area. Specifically, the controller 130 may determine the central area of an image as the attentive area and the edge area thereof as the inattentive area (see FIG. 3A).

In the case of determining the inattentive area based on the factor related to whether or not effective image data exists, the controller 130 may determine areas corresponding to a letter box (see FIG. 3B) or a pillar box (see FIG. 3C) as the inattentive area and the other areas as the attentive area.

The image information used by the controller 130 to determine whether or not a user can recognize an adjustment of the image may include at least one of a frequency of an image, a contrast thereof, and an edge characteristic thereof.

In accordance with an exemplary embodiment, the controller 130 may control the image processor 120 to adjust the brightness of a portion of the inattentive area where a user cannot recognize the brightness change thereof. In this case, the controller 130 may detect an area having a relatively high frequency of the image as the portion where the brightness change cannot be recognized by the user. In addition, the controller 130 may detect an area having a relatively low contrast of the image as the portion where the brightness change cannot be recognized by the user.

In accordance with a modification of the present exemplary embodiment, the controller 130 may control the image processor 120 to adjust the brightness of the inattentive area such that a portion of the inattentive area having a level where the brightness change cannot be recognized by the user is adjusted differently from a portion of the inattentive area having a level where the brightness change can be recognized by the user.

In the meantime, the controller 130 may determine a brightness adjusting level of the inattentive area is adjusted in consideration of whether or not a local dimming is performed. For example, in the case of performing the local dimming on the inattentive area, the controller 130 may control the brightness adjusting level of the inattentive area in consideration of the brightness level reduced by the local dimming.

The controller 130 may adjust the brightness of the inattentive area by controlling an image or a backlight. Specifically, in the case of controlling the image, the controller 130 may adjust the brightness of the inattentive area by controlling a gray scale of the image. In addition, the controller 130 may control the brightness of the inattentive area by controlling the backlight. In detail, the controller 130 may adjust the intensity of a light emitted from the backlight and/or a light emitting time of the backlight.

For example, in case that the display panel is embodied as a passive display device, it is possible to control both the image and the backlight. On the other hand, in case that the display panel is embodied as an active display device such as an OLED or a PDP, it is possible to control the image. This may be because the OLED, the PDP, and the like are a self-emitting devices that do not need the backlight.

Figure 2:
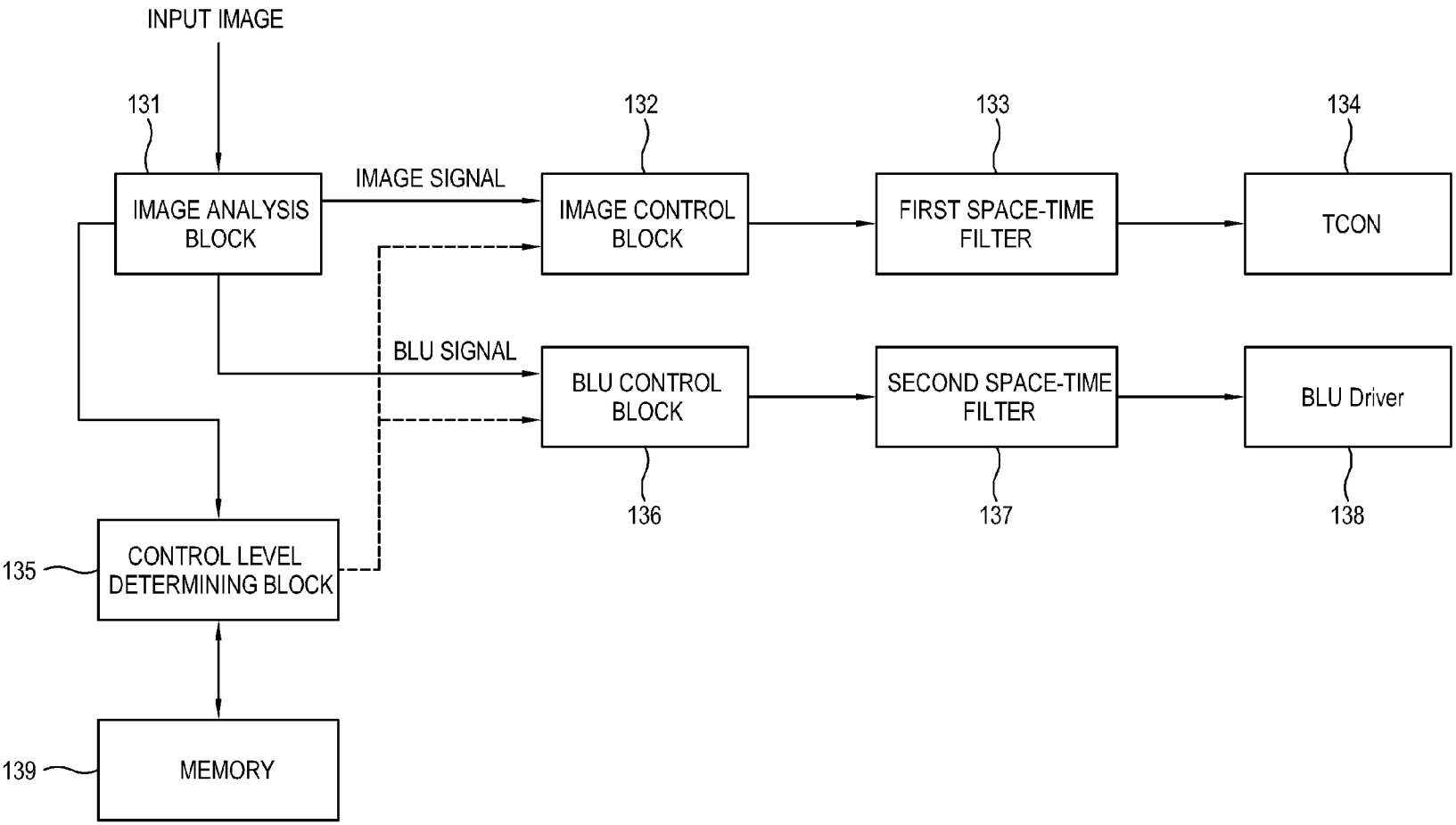
FIG. 2 shows a block diagram of a controller of FIG. 1 and how an image signal is processed in the controller in accordance with an exemplary embodiment.

FIG. 2 shows a block diagram of a controller of FIG. 1 and how an image signal is processed in the controller 130 in accordance with an exemplary embodiment.

The controller 130 of an exemplary embodiment may include an image analysis block 131, an image control block 132, a first space-time filter 133, a timing controller (TCON) 134, a control level determining block 135, a backlight unit (BLU) control block 136, a second space-time filter 137, a BLU driver 138, and a memory 139.

The image analysis block 131 may determine an attentive area and an inattentive area by analyzing an image. For example, the image analysis block 131 may detect areas corresponding to a pillar box and/or a letter box in the image and determine the detected areas as the inattentive area.

The image control block 132 may determine whether or not the brightness can be adjusted in consideration of a psycho-visual characteristic of a user. Specifically, a portion where the brightness change cannot be recognized by a user, for example, due to a frequency above a predetermined frequency level or due to a contrast below a predetermined contrast level, may be determined as an area where the brightness can be adjusted. On the other hand, a portion where the brightness change can be recognized by a user may be determined as an area where the brightness cannot be adjusted.

In this case, the image control block 132 may compensate the gray scale of an area of an image where the brightness can be adjusted.

The first and the second space-time filter 133 and 137 may analyze characteristics of a time frequency and a spatial frequency of an image. Specifically, the first and the second space-time filter 133 and 137 may filter only predetermined spatial and time frequencies of an image and analyze the characteristics of a time frequency and a spatial frequency of an image based on the filtered frequencies.

The TCON 134 may control the driving timing of an image. Specifically, the TCON 134 may adjust a display period of sub-field or a display gray scale of image.

The control level determining block 135 may determine a brightness adjustment level of image by using information detected by the image analysis block 131. In this case, the control level determining block 135 may refer to a look up table (LUT) stored in the memory 139, the LUT being related to a brightness adjusting level depending on the psycho-visual characteristic of a user, which corresponds to the frequency or the contrast of the image, for example. Moreover, the control level determining block 135 may cooperate with a brightness adjusting algorithm such as a global dimming or a local dimming to determine the brightness adjustment level.

The BLU control block 136 may determine whether to control the backlight. In this case, the BLU control block 136 may control the BLU driver 138 to increase or decrease a light intensity or a light emitting time.

The BLU driver 138 may drive the backlight. Specifically, the BLU driver 138 may adjust a light emitting intensity of the backlight or a light emitting time thereof under the control of the BLU control block 136.

The memory 139 may store the LUT related to the brightness adjustment level depending on the psycho-visual characteristic of a user.

When the brightness of the inattentive area is adjusted by controlling the image, an input image signal may be processed via the image analysis block 131→the control level determining block 135→the image control block 132→the first space-time filter 133→the TCON 134.

When the brightness of the inattentive area is adjusted by controlling the backlight, an input image signal may be processed via the image analysis block 131→the control level determining block 135→the BLU control block 136→the second space-time filter 137→the BLU driver 138.

Meanwhile, the brightness of the inattentive area may be adjusted by controlling both the image and the backlight. In this case, an input image signal may be processed through both routes.

Figure 3A:
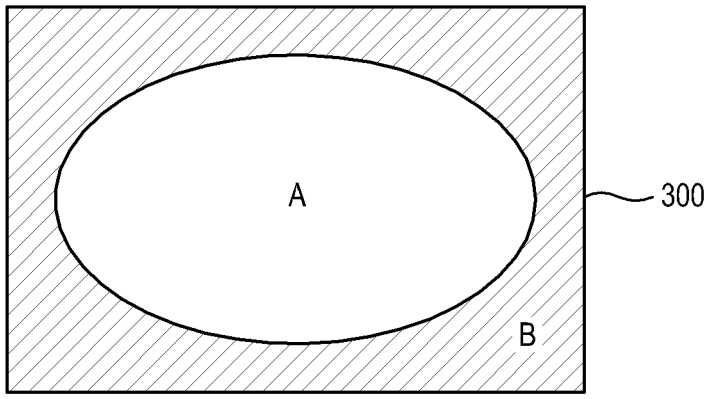
FIG. 3A shows an attentive area and an inattentive area that are separated in an image in accordance with an exemplary embodiment.

FIG. 3A shows an attentive area and an inattentive area that are separated according to a specific area in an image in accordance with an exemplary embodiment.

Typically, a central portion of the display apparatus 100, i.e., a central area A of an image 300, is an area which a user generally keeps his/her eye, and thus may be determined as the attentive area even though few image data exists per block therein.

A peripheral portion of the display apparatus 100, i.e., an edge area B of the image 300 may be determined as an inattentive area serving as the area to which the user is inattentive. Here, the edge area B completely surrounds the central area A.

Accordingly, the areas A and B may be determined as the attentive area and the inattentive area, respectively, in FIG. 3A. The shape and size of area A may be set automatically according to a predetermined shape and size. Alternatively, the shape and size of area A may be set and/or adjusted by receiving a user input by selecting one of various stored settings.

In one exemplary embodiment, the image analysis block 131 may automatically detect an aspect ratio of an input image and an aspect ratio of an image output from the display apparatus 100, and if the aspect ratios are the same, the image analysis block 131 may automatically set area A to a predetermined size and shape (see e.g., FIG. 3A).

Figure 3B:
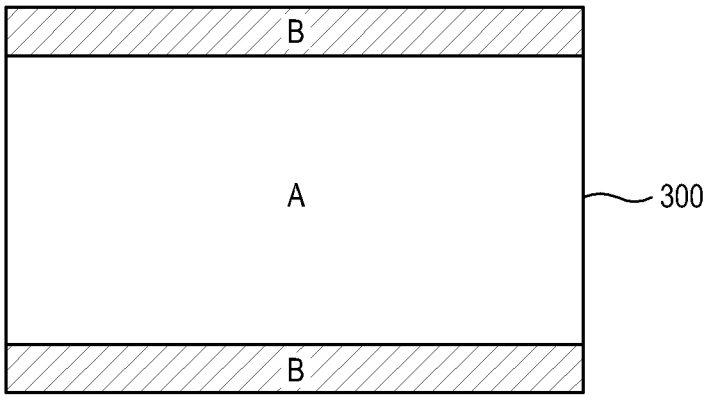
FIG. 3B shows an attentive area and an inattentive area that are separated in an image in accordance with another exemplary embodiment.

FIG. 3B shows an attentive area and an inattentive area that are separated according to a determination by the image analysis block 131 that the areas correspond to a letter box in accordance with an exemplary embodiment;

The letter box indicates ineffective image data inserted into an upper and a lower area of an image to adjust the aspect ratio (the ratio of a horizontal to a vertical side) of the image. For example, when an image having the aspect ratio of 16:9 is input and an image having the aspect ratio of 4:3 is output from the display apparatus 100, the letter box may occur. Accordingly, the image analysis block 131 may automatically detect this difference in aspect ratios by analyzing the image, thereby detecting the letter box area.

Area A of the image 300 where effective image data exists may be determined as the attentive area serving as an area to which a user is most attentive.

A letter box area, i.e., an area B, of the image 300 may be determined as the inattentive area serving as an area to which the user is most inattentive.

As a result, the areas A and B may be determined as the attentive area and the inattentive area, respectively, in FIG. 3B.

Figure 3C:
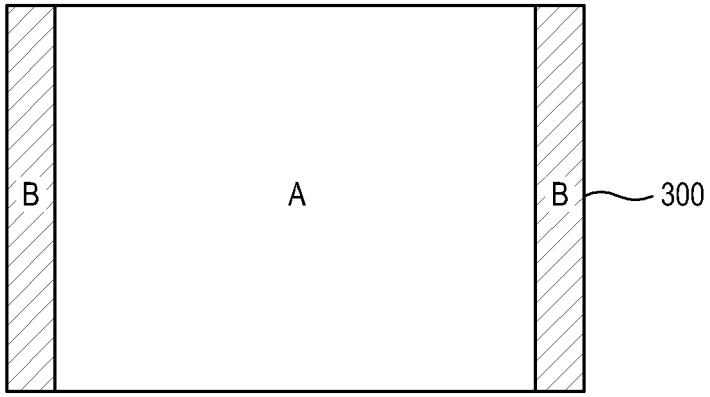
FIG. 3C shows an attentive area and an inattentive area that are separated in an image in accordance with another exemplary embodiment.

FIG. 3C shows an attentive area and an inattentive area that are separated according to a determination by the image analysis block 131 that the areas correspond to a pillar box in accordance with an exemplary embodiment.

The pillar box indicates ineffective image data inserted into a left and a right area of an image to adjust the aspect ratio (the ratio of a horizontal to a vertical side) of the image. For example, when an image having the aspect ratio of 4:3 is input and an image having the aspect ratio of 16:9 is output from the display apparatus 100, the pillar box may occur. Accordingly, the image analysis block 131 may automatically detect this difference in aspect ratios by analyzing the image, thereby detecting the pillar box area.

Area A of the image 300 where effective image data exists may be determined as the attentive area serving as an area to which a user is most attentive.

A pillar box area, i.e., an area B, of the image 300 may be determined as the inattentive area serving as an area to which the user is most inattentive.

As a result, the areas A and B may be determined as the attentive area and the inattentive area, respectively, in FIG. 3C.

Figure 4A:
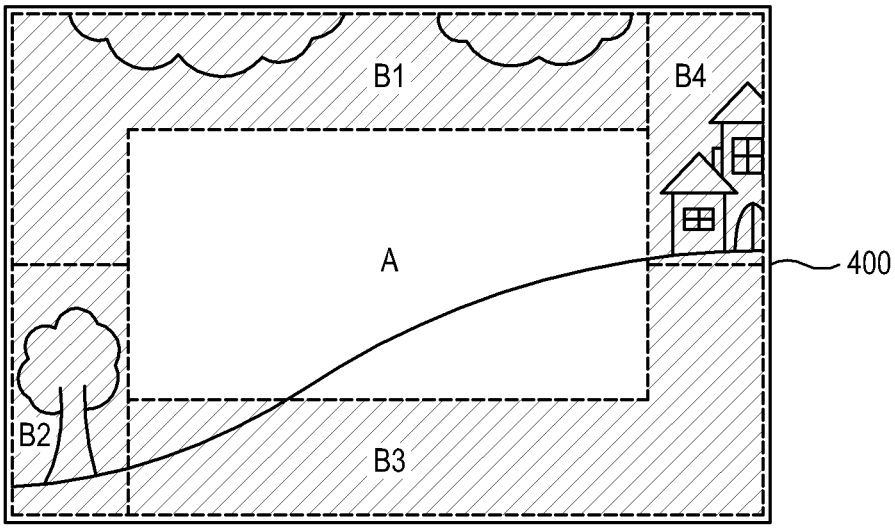
FIG. 4A shows a brightness adjustable area and a brightness non-adjustable area that are separated according to a spatial frequency in accordance with an exemplary embodiment.

FIG. 4A shows a brightness adjustable area and a brightness non-adjustable area that are separated according to a spatial frequency in accordance with an exemplary embodiment.

A spatial frequency indicates how many times a line is repeated per unit area of an image. If the spatial frequency is high, the image may be displayed in detail sufficiently. On the other hand, if the spatial frequency is low, a general outline of the image may be more obviously displayed. For example, when an overall screen area has the same color, a corresponding image may be in a very smooth state or in an unchanged state. As such, when the image is changed slowly and smoothly throughout, the spatial frequency may be low. On the other hand, the screen area has checkered patterns, a corresponding image may be in an irregular state or in a very changeable state. As such, when the image is wildly changed throughout, the spatial frequency is high. At this time, the spatial frequency may be similar to a water wave with many undulations.

When the spatial frequency is high, a user's eye may not be sensitive to changes in brightness since a user's eye cannot easily detect changes in brightness in high frequency images. This may be because the user's eye is wandering toward details of the image and, thus, it is difficult to recognize the brightness change.

In FIG. 4A, an area A, i.e., a central area, of an image 400 may be the attentive area. Areas B1, B2, B3, and B4, i.e., edge areas, of the image 400 may be the inattentive area. Moreover, the areas B1 and B3 of the inattentive area in the image 400, which is in the smooth state, may be detected by the image analysis block 131 as having a low spatial frequency. On the other hand, the areas B2 and B4 thereof in the image 400, which is in the irregular state, may be detected by the image analysis block 131 as having a high spatial frequency.

Since the attentive area is the area to which a user is mostly attentive, the user's eye may be sensitive to the brightness change of the attentive area. Accordingly, when the brightness of the image 400 is adjusted, the brightness of the area A may not be adjusted.

The inattentive area is the area to which a user is least attentive. However, effective image data may exist in the inattentive area. Specifically, in case that the attentive area and the inattentive area are separated according to whether or not to correspond to the letter box or the pillar box as shown in FIGS. 3B and 3C, no effective image data may exist in the inattentive area. On the other hand, in case that the attentive area and the inattentive area are separated according to a specific area in the image as shown in FIG. 3A, effective image data may exist in the inattentive area.

Since a portion of the inattentive area of the image 400 having a low spatial frequency is in the smooth state, the user's eye may be sensitive to the brightness change of the low frequency portion. In other words, since the user's eye is not wandering toward the detail of the image 400 in the case of the low spatial frequency, the user's eye may easily recognize the brightness change thereof. Accordingly, even though a portion is included in the inattentive area, if the portion has a low spatial frequency, the brightness of the portion may not be adjusted. In other words, when the brightness of the image 400 is adjusted, areas B1 and B3 are separated out from areas B2 and B4 by the image analysis block 131 such that the brightness of the areas B1 and B3 may not be adjusted. Accordingly, once an inattentive area is set according to FIG. 3A, the image analysis block 131 may analyze the inattentive area to separate out any additional areas which should not have a brightness adjusted based on a psycho-visual characteristic of the user.

Since, however, a portion having the high spatial frequency of the inattentive area of the image 400 is in the irregular state, the user's eye may not be sensitive to the brightness change thereof. In other words, since the user's eye is wandering toward the detail of the image 400 in the case of the high spatial frequency, the user's eye may not easily recognize the brightness change thereof. Accordingly, when a portion is included in the inattentive area, if the portion has a high spatial frequency, the brightness of the portion may be adjusted. In other words, when the brightness of the image 400 is adjusted, the brightness of the areas B2 and B4 may be adjusted.

In accordance with a modification of the present exemplary embodiment, when the brightness of the inattentive area is adjusted, a brightness adjustment level of a portion of the inattentive area where the brightness change cannot be recognized by a user (i.e., an area having a high spatial frequency) may be controlled differently from that where the brightness change can be recognized by a user (i.e., an area having a low spatial frequency). Specifically, the brightness may be adjusted by a large degree in the portion thereof where the brightness change cannot be recognized by a user, while the brightness may be adjusted by a small degree in the portion thereof where the brightness change can be recognized by a user. For example, in FIG. 4A, the brightness of the areas B2 and B4 are reduced by 4 levels, while the brightness of the areas B1 and B3 are reduced by 2 levels. The control level determining block 135 determines to what degree a portion in the inattentive area may be adjusted by, for example, looking up a brightness level in a LUT which corresponds to a particular value of the psycho-visual characteristic detected by the image analysis block 131.

Figure 4B:
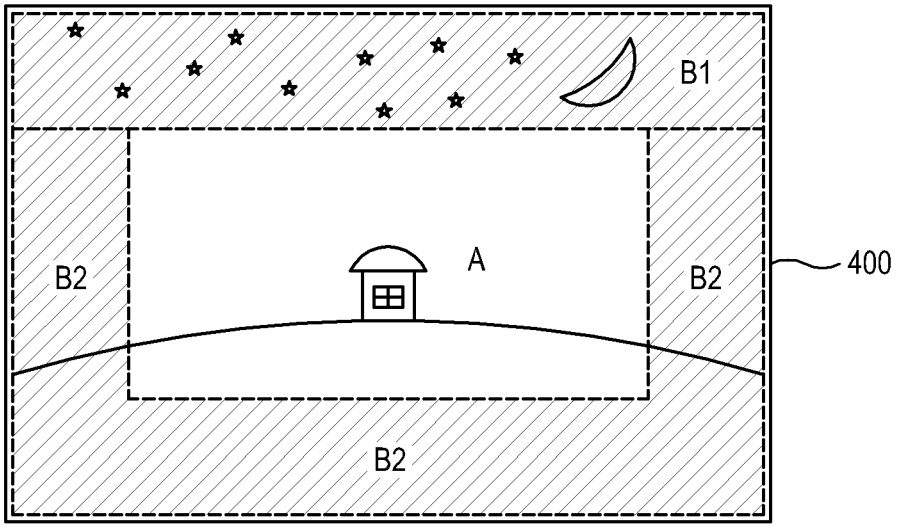
FIG. 4B shows a brightness adjustable area and a brightness non-adjustable area that are separated according to a contrast in accordance with another exemplary embodiment.

FIG. 4B shows a brightness adjustable area and a brightness non-adjustable area that are separated according to a contrast in accordance with an exemplary embodiment.

The contrast indicates the difference between a bright area and a dark area of an image. When the difference therebetween is large, the contrast is high. When the difference therebetween is slight, the contrast is low.

When the contrast is high, a user's eye may be sensitive to a change in brightness. In this case, this may be because even slight change of brightness is more obviously recognized by a user due to the high contrast. Accordingly, a brightness in an area which has a high contrast (i.e., a contrast above a predetermined value) should not be changed.

In FIG. 4B, a central area, i.e., an area A, of the image 400 may be an attentive area, while edge areas, i.e., areas B1 and B2, of the image 400 may be an inattentive area.

In FIG. 4B, the area B1 includes a black-colored night sky, a yellow-colored moon, and white-colored stars. The area B2 includes a black-colored night sky and a dark green-colored field. At this time, since the area B1 has a large difference between a bright area and a dark area, the area B1 may have a high contrast. Since the area B2 has a slight difference between a bright area and a dark area, the area B2 may have a low contrast.

Since the attentive area is the area to which a user is mostly attentive, the user's eye may be sensitive to the brightness change of the attentive area. Accordingly, when the brightness of the image 400 is adjusted, the brightness of the area A may not be adjusted.

In the case of a high-contrast portion of the inattentive area, the user's eye may be sensitive to the brightness change of the high-contrast portion. In other words, since the brightness change of the high-contrast portion is more obviously recognized by a user due to the high contrast, the user may easily recognize the brightness change thereof. Accordingly, even though a portion is included in the inattentive area, if the portion has a high contrast, the brightness of the portion may not be adjusted. In FIG. 4B, when the brightness of the image 400 is adjusted, the brightness of the area B1 may not be adjusted.

In the case of a low-contrast portion of the inattentive area, the user's eye may not be sensitive to the brightness change of the low-contrast portion. In other words, since the brightness change of the low-contrast portion is diluted with the low contrast, the user may not easily recognize the brightness change thereof. Accordingly, when a portion is included in the inattentive area and has a low contrast, the brightness of the portion may be adjusted. In FIG. 4B, when the brightness of the image 400 is adjusted, the brightness of the area B2 may be adjusted. Accordingly, once an inattentive area is set according to FIG. 3A, the image analysis block 131 may analyze the inattentive area to separate out any additional areas which should not have a brightness adjusted based on a psycho-visual characteristic of the user. The control level determining block 135 determines to what degree a portion in the inattentive area may be adjusted by, for example, looking up a brightness level in a LUT which corresponds to a particular value of the psycho-visual characteristic detected by the image analysis block 131.

Figure 5A:
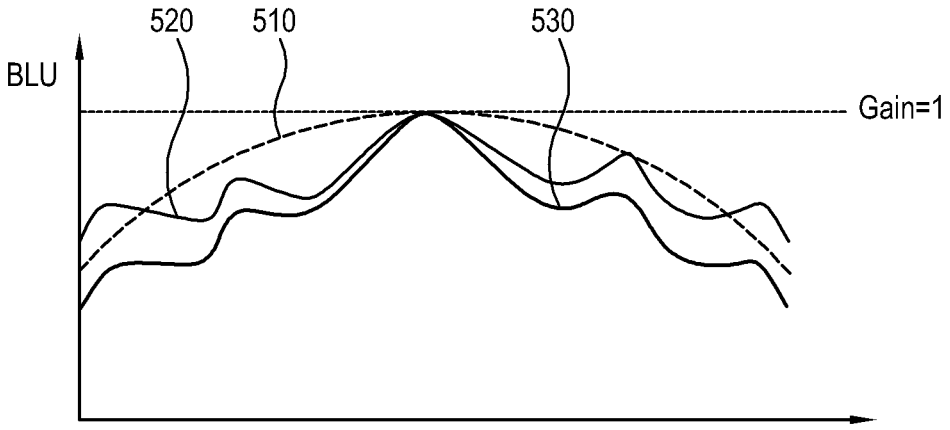
FIG. 5A shows a brightness of a backlight which is controlled in accordance with an exemplary embodiment.
Figure 5B:
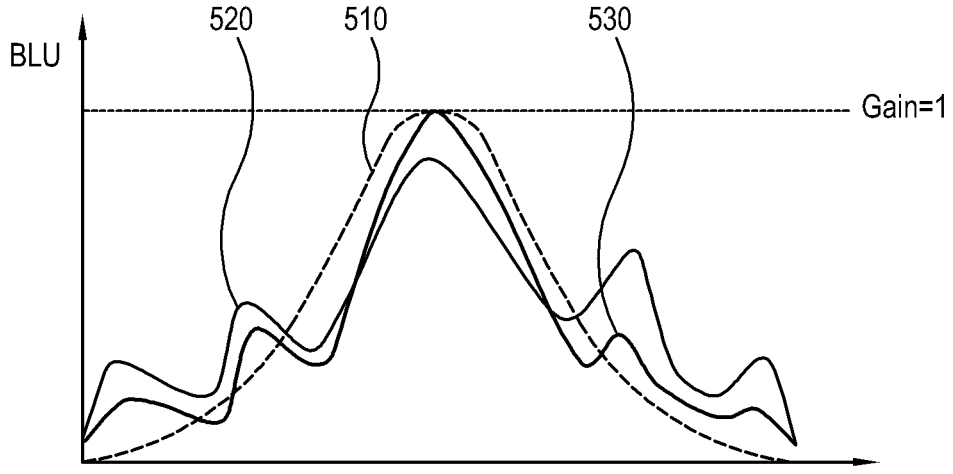
FIG. 5B shows a brightness of a backlight which is controlled in accordance with another exemplary embodiment.

FIG. 5A shows a brightness of a backlight controlled in accordance with an exemplary embodiment, and FIG. 5B shows a brightness of a backlight controlled in accordance with another exemplary embodiment.

It is assumed that the brightness of a typical image is reduced in FIG. 5A, while the brightness of an image having a bright central area and a dark edge area is reduced in FIG. 5B.

An OABC gain curve 510 indicates an ideal brightness level of a backlight unit (BLU). In this case, the OABC gain curve 510 indicates a bright level per block, showing that the brightness of an image becomes reduced from a central area to an edge area thereof.

A usual brightness curve of a BLU 520 indicates an actual brightness level in case that an image is displayed as it is without the brightness adjustment.

A final brightness curve of a BLU 530 indicates an actual brightness level in case that an image is displayed through the brightness adjustment.

Referring to FIG. 5A, the usual brightness curve of a BLU 520 has the same value as that of the final brightness curve of a BLU 530 at a central area of the image. In other words, the central area is an attentive area and, thus, the brightness thereof is not adjusted. However, the difference between the curves 520 and 530 becomes increased from the central area to the edge area. In other words, the edge area is an inattentive area and, thus, the brightness thereof is adjusted and the brightness adjustment level becomes increased from the central area to the edge area.

Referring to FIG. 5B, the OABC gain curve 510 has the same value as that of the final brightness curve of a BLU 530 at the central area of the image. In other words, the central area is the attentive area and, thus, the image is displayed brighter than that of the usual brightness curve of a BLU 520. Typically, the brightness of the attentive area may not be adjusted. On the other hand, the brightness thereof may be increased on an exception. This may be because a user is less sensitive to the increase in brightness than to the decrease in brightness.

The other edge areas are the inattentive area and, thus, the curve 530 has a darker value than that of the usual brightness curve of a BLU 520. In this case, even though the edge areas are more darkly displayed, the overall brightness of the image may be balanced due to the more brightly displayed central area. Accordingly, the user may not easily recognize the brightness change of the image.

In addition, the power saved by reducing the brightness of the edge areas may be more than the power used to increase the brightness of the central area. Accordingly, the power consumption may be reduced by the difference therebetween.

Figure 6:
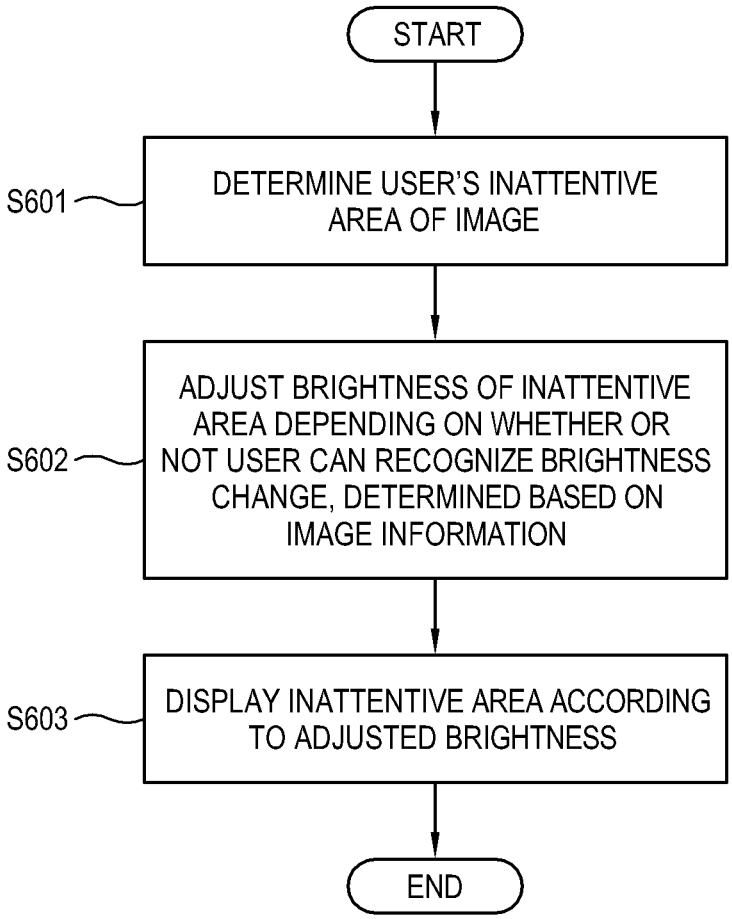
FIG. 6 is a flowchart showing a process of controlling a display apparatus in accordance with an exemplary embodiment.

FIG. 6 is a flowchart showing a process of controlling the display apparatus 100 in accordance with an exemplary embodiment.

The display apparatus 100 may determine an inattentive area of an input image (S601). Specifically, the display apparatus 100 may divide the input image into a plurality of blocks and separate the blocks into an attentive area and an inattentive area according to image characteristics per block. In accordance with an exemplary embodiment, since a central area of the display apparatus 100 is an area to which a user is mostly attentive, the central area may be determined as the attentive area even through less image data exist in the central area. Moreover, since an edge area of the display apparatus 100 is an area to which the user is mostly inattentive, the edge area may be determined as the inattentive area except for a special case. Here, the special case may indicate a case of having a low spatial frequency or high contrast. The special case may be determined through the analysis of contrast, frequency, or both.

The display apparatus 100 may adjust the brightness of the inattentive area depending on whether or not the user can recognize the brightness change thereof, determined based on image information (S602). Specifically, the display apparatus 100 may acquire an adjustable level for each block by using data related to separately attentive and inattentive areas. In this case, the display apparatus 100 may refer to a look up table (LUT) stored in the memory 139, the LUT being related to a brightness adjusting level depending on the psycho-visual characteristic of the user. Typically, a brightness adjustment level may be determined depending on the characteristics of the inattentive area.

In the meantime, the display apparatus 100 may adjust the brightness of the inattentive area by controlling the image or a backlight unit. Specifically, in the case of controlling the image, the display apparatus 100 may adjust the brightness of the inattentive area by controlling a gray scale of the image. Alternatively or in addition to, in the case of controlling the backlight, the display apparatus 100 may adjust the brightness of the inattentive area by controlling the intensity of a light emitted from the backlight and/or a light emitting time of the backlight.

The display apparatus 100 may display the inattentive area based on the adjusted brightness (S603).

As described above, in accordance with the exemplary embodiments of the general inventive concept, it is possible to improve an image quality sensed by a user and reduce power consumption by controlling the brightness of an input image based on an image analysis performed depending on the psycho-visual characteristic of a user after an area that is attentive by the user and the other areas are separately detected from the image.

It is possible to reduce the power consumption at a level at which the user can not sense brightness reduction and image quality reduction by controlling the input image or a backlight with the use of characteristics when the user is attentive to the display apparatus or the analysis of characteristics of the image.

Further, when an image is displayed by a self-emitting display element, it is possible to extend the lifespan of the display element and reduce the power consumption thereof.

Although a few exemplary embodiments have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. A display apparatus comprising:

a display unit;

an image processor configured to process an image and display the processed image on the display unit;

an image analysis unit configured to determine an attentive area and an inattentive area of the image by analyzing image information; and an image control unit configured to control the image processor to adjust a brightness of the inattentive area of the image displayed on the display unit based on the analyzed image information, wherein the image control unit determines whether or not the brightness can be adjusted in consideration of a psycho-visual characteristic of a user and compensates the gray scale of an area of an image where the brightness can be adjusted.

2. The apparatus of claim 1, wherein the image control unit controls the image processor to adjust the brightness of a portion of the inattentive area where a user is not able to recognize a brightness change based on the analyzed image information.

3. The apparatus of claim 1, wherein the image analysis unit determines the inattentive area based on at least one of a factor related to a specific area in the image and another factor related to whether effective image data exists therein.

4. The apparatus of claim 1, wherein the image analysis unit determines a central area of the image as an attentive area of the image and other areas of the image, except for the attentive area, as the inattentive area of the image.

5. The apparatus of claim 1, wherein the image information comprises a frequency, a contrast, and an edge characteristic of the image.

6. The apparatus of claim 5, wherein the image analysis unit determines an area of the inattentive area of the image having a frequency above a predetermined frequency level as an area where the user is not able to recognize the corresponding brightness change.

7. The apparatus of claim 5, wherein the image analysis unit determines an area of the inattentive area of the image having a contrast below a predetermined contrast level as an area where the user is not able to recognize the corresponding brightness change.

8. The apparatus of claim 1, wherein the image analysis unit determines a brightness adjustment level of the inattentive area in consideration of whether a local dimming is performed.

9. The apparatus of claim 1, wherein the image control unit adjusts the brightness of the inattentive area of the image by controlling a gray scale of the image.

10. The apparatus of claim 1, wherein the display unit comprises a backlight, and the image control unit adjusts the brightness of the inattentive area of the image by controlling the backlight.

11. A method for controlling a display apparatus, the method comprising:

determining an attentive area of an image and an inattentive area of the image by analyzing image information;

adjusting a brightness of the inattentive area based on the analyzed image information; and displaying the inattentive area according to the adjusted brightness, wherein the brightness of the inattentive area is adjusted if determined that a user is not able to recognize a corresponding brightness change, and wherein an area of the inattentive area of the image having a frequency above a predetermined frequency level is determined as an area where the user is not able to recognize the corresponding brightness change.

12. The method of claim 11, wherein the brightness of a portion of the inattentive area where the user is not able to recognize the brightness change is adjusted based on the image information.

13. The method of claim 11, wherein the inattentive area is determined based on at least one of a factor related to a specific area in the image and another factor related to whether effective image data exists.

14. The method of claim 11, wherein a central area of the image is determined as an attentive area of the image and other areas of the image, except for the attentive area, are determined as the inattentive area of the image.

15. The method of claim 11, wherein the image information comprises a frequency, a contrast, and an edge characteristic of the image.

16. The method of claim 15, wherein an area of the inattentive area of the image having a contrast below a predetermined contrast level is determined as an area where the user is not able to recognize the corresponding brightness change.

17. The method of claim 11, wherein a brightness adjustment level of the inattentive area is determined in consideration of whether a local dimming is performed.

18. The method of claim 11, wherein the brightness of the inattentive area of the image is adjusted by controlling a gray scale of the image.

19. The method of claim 11, wherein the display apparatus comprises a backlight, and the brightness of the inattentive area of the image is adjusted by controlling the backlight.

20. A display apparatus comprising:

a display unit;

an image processor which processes an image and displays the processed image on the display unit;

an image analysis unit configured to determine an attentive area and an inattentive area of the image by analyzing image information; and an image control unit configured to control the image processor to adjust a brightness of the inattentive area of the image displayed on the display unit based on the analyzed image information, wherein the image control unit determines whether or not the brightness can be adjusted in consideration of a psycho-visual characteristic of a user and compensates the gray scale of an area of an image where the brightness can be adjusted.

21. The apparatus of claim 20, wherein the image analysis unit separates the image into the attentive area and the inattentive area which correspond to a central area and an edge area, respectively, such that the central area has a predetermined size and shape, and the edge area surrounds the central area.

22. The apparatus of claim 20, wherein the image analysis unit analyzes the image by determining an input aspect ratio of the image and an output aspect ratio of the image, by comparing the input aspect ratio with the output aspect ratio, and by separating the image into the attentive area and the inattentive area based on a comparison result.

23. The apparatus of claim 22, wherein:

if the input aspect ratio is equal to the output aspect ratio, the image analysis unit separates the image into the attentive area and the inattentive area which correspond to a central area and an edge area, respectively, such that the central area has a predetermined size and shape, and the edge area surrounds the central area, if the input aspect ratio is 4:3 and the output aspect ratio is 16:9, the image analysis unit separates the image into the attentive area and the inattentive area according to a pillar box arrangement such that the inattentive area includes a ride side and a left side of the image, and the input aspect ratio is 16:9 and the output aspect ratio is 4:3, the image analysis unit separates the image into the attentive area and the inattentive area according to a letter box arrangement such that the inattentive area includes an upper side and a lower side of the image.

24. The apparatus of claim 20, wherein the image analysis unit divides the inattentive area into a plurality of inattentive portions based on the image information related to the psycho-visual characteristic of the user, and the image analysis unit determines a brightness adjustment level separately for each of the plurality of inattentive portions according to the image information of each of the plurality of inattentive portions.

25. The apparatus of claim 24, wherein the image control unit only adjusts the brightness of an inattentive portion of the plurality of inattentive portions if the inattentive portion has a frequency above a predetermined frequency level and has a contrast below a predetermined contrast level.

* * * * *